US006263869B1

(12) United States Patent
Abernethy

(10) Patent No.: US 6,263,869 B1
(45) Date of Patent: Jul. 24, 2001

(54) STOVE COVER DEVICE

(76) Inventor: Todd W. Abernethy, 83 Martindale Road, Saint Catharines, Ontario (CA), L2S 2Y5

( * ) Notice: Subject to any disclaimer, the term of this patent is extended or adjusted under 35 U.S.C. 154(b) by 0 days.

(21) Appl. No.: 09/548,242

(22) Filed: Apr. 12, 2000

(51) Int. Cl.[7] ..... F24C 15/10
(52) U.S. Cl. ..... 126/211; 126/215; 126/39 B
(58) Field of Search ..... 126/211, 217, 126/218, 214 R, 214 A, 214 C, 214 D, 212, 220, 42, 39 B, 215, 216

(56) References Cited

U.S. PATENT DOCUMENTS 2,411,464 * 11/1946 Reeves ..... 126/39
2,536,513 * 1/1951 O'Keefe ..... 126/214 R
2,696,812 * 12/1954 Merritt, Jr. ..... 126/214 R
3,059,632 * 10/1962 Rogers ..... 126/214 R
4,155,343 * 5/1979 Hartman ..... 126/211
4,934,333 * 6/1990 Ducate, Jr. et al. ..... 126/211
5,115,797 * 5/1992 Hurner ..... 126/214 R
5,331,945 * 7/1994 Somerton ..... 126/211
6,021,774 * 2/2000 Taplan et al. ..... 126/211
6,044,834 * 4/2000 Zappetti ..... 126/214 D

FOREIGN PATENT DOCUMENTS 8801-604 * 6/1988 (NL) ..... 126/211

* cited by examiner

*Primary Examiner*—Ira S. Lazarus
*Assistant Examiner*—Josiah C. Cocks

(57) ABSTRACT

A stove cover device for creating additional counter space by covering the top surface of the stove. The stove cover device includes a covering member for covering the top surface of a stove. The covering member includes a plate. The plate has a top surface, a bottom surface, and a peripheral edge. A peripheral wall extends away from and is integrally coupled to the peripheral edge. A pair of securing means removably secures the peripheral wall to the panel on the stove. Each of the securing means is adapted for removably coupling to a panel of the stove.

5 Claims, 3 Drawing Sheets

STOVE COVER DEVICE

BACKGROUND OF THE INVENTION

1. Field of the Invention

The present invention relates to stove covers and more particularly pertains to a new stove cover device for creating additional counter space by covering the top surface of the stove.

2. Description of the Prior Art

The use of stove covers is known in the prior art. More specifically, stove covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,331,945; U.S. Pat. No. 5,115,797; U.S. Pat. No. 386,945; U.S. Pat. No. 5,078,122; U.S. Des. Pat. No. 348,800; and U.S. Pat. No. 2,696,812.

While these devices fulfill their respective, particular objectives and requirements, the aforementioned patents do not disclose a new stove cover device. The inventive device includes a covering member for covering the top surface of a stove. The covering member includes a plate. The plate has a top surface, a bottom surface, and a peripheral edge. A peripheral wall extends away from and is integrally coupled to the peripheral edge. A pair of securing means removably secures the peripheral wall to the panel on the stove. Each of the securing means is adapted for removably coupling to a panel of the stove.

In these respects, the stove cover device according to the present invention substantially departs from the conventional concepts and designs of the prior art, and in so doing provides an apparatus primarily developed for the purpose of for creating additional counter space by covering the top surface of the stove.

SUMMARY OF THE INVENTION

In view of the foregoing disadvantages inherent in the known types of stove covers now present in the prior art, the present invention provides a new stove cover device construction wherein the same can be utilized for creating additional counter space by covering the top surface of the stove.

The general purpose of the present invention, which will be described subsequently in greater detail, is to provide a new stove cover device apparatus and method which has many of the advantages of the stove covers mentioned heretofore and many novel features that result in a new stove cover device which is not anticipated, rendered obvious, suggested, or even implied by any of the prior art stove covers, either alone or in any combination thereof.

To attain this, the present invention generally comprises a covering member for covering the top surface of a stove. The covering member includes a plate. The plate has a top surface, a bottom surface, and a peripheral edge. A peripheral wall extends away from and is integrally coupled to the peripheral edge. A pair of securing means removably secures the peripheral wall to the panel on the stove. Each of the securing means is adapted for removably coupling to a panel of the stove.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stove cover device apparatus and method which has many of the advantages of the stove covers mentioned heretofore and many novel features that result in a new stove cover device which is not anticipated, rendered obvious, suggested, or even implied by any of the prior art stove covers, either alone or in any combination thereof.

It is another object of the present invention to provide a new stove cover device which may be easily and efficiently manufactured and marketed.

It is a further object of the present invention to provide a new stove cover device which is of a durable and reliable construction.

An even further object of the present invention is to provide a new stove cover device which is susceptible of a low cost of manufacture with regard to both materials and labor, and which accordingly is then susceptible of low prices of sale to the consuming public, thereby making such stove cover device economically available to the buying public.

Still yet another object of the present invention is to provide a new stove cover device which provides in the apparatuses and methods of the prior art some of the advantages thereof, while simultaneously overcoming some of the disadvantages normally associated therewith.

Still another object of the present invention is to provide a new stove cover device for creating additional counter space by covering the top surface of the stove.

Yet another object of the present invention is to provide a new stove cover device which includes a covering member for covering the top surface of a stove. The covering member includes a plate. The plate has a top surface, a bottom surface, and a peripheral edge. A peripheral wall extends away from and is integrally coupled to the peripheral edge. A pair of securing means removably secures the peripheral wall to the panel on the stove. Each of the securing means is adapted for removably coupling to a panel of the stove.

Still yet another object of the present invention is to provide a new stove cover device that has a securing means for securing the cover to the stove.

Even still another object of the present invention is to provide a new stove cover device that has a gripping means for ease of release of the securing means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
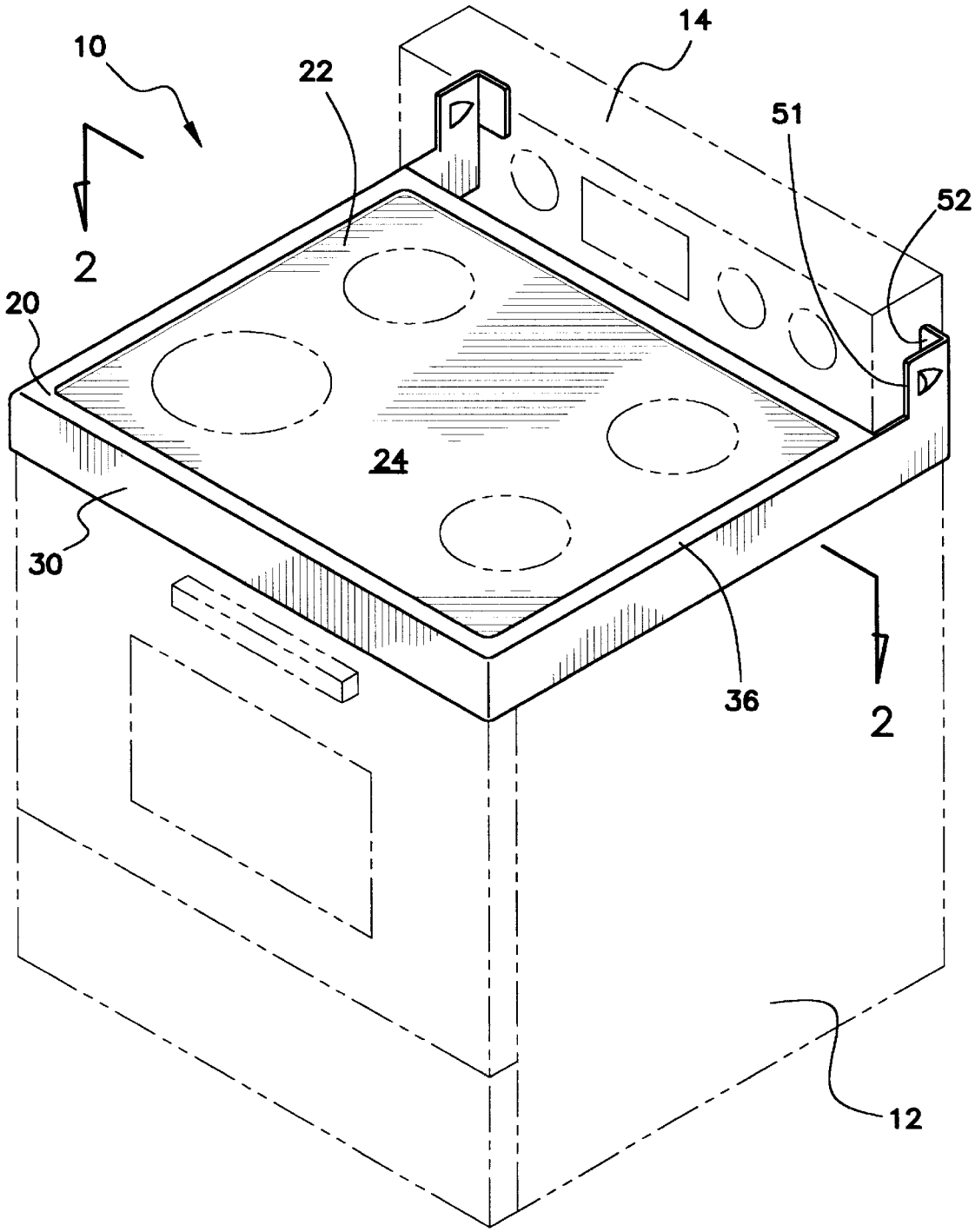
FIG. 1 is a schematic perspective view of a new stove cover device according to the present invention.
Figure 2:
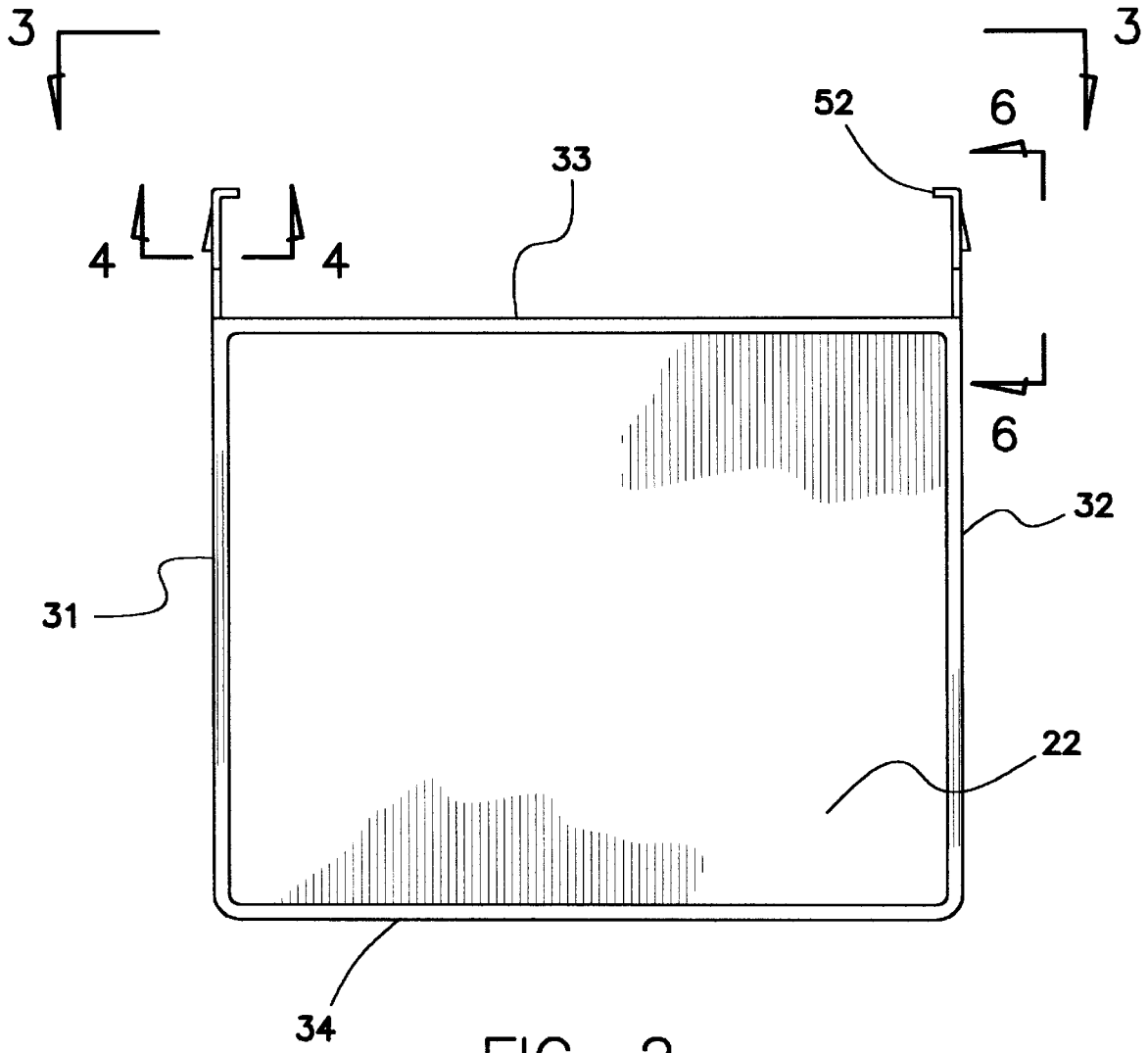
FIG. 2 is a schematic plan view of the present invention.
Figure 3:
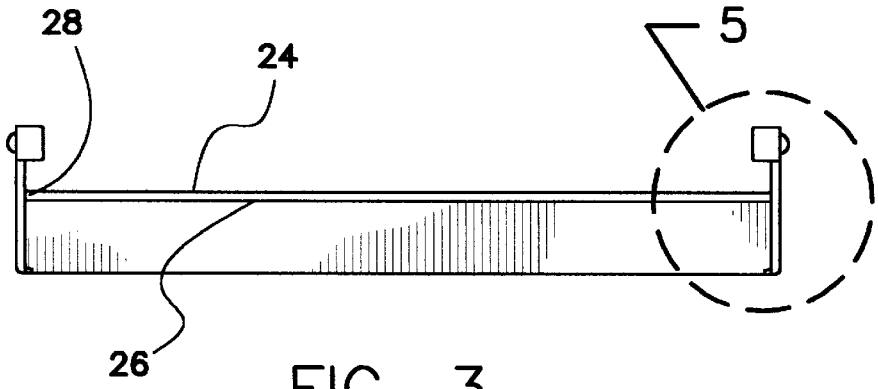
FIG. 3 is a schematic end view of the present invention.
Figure 4:
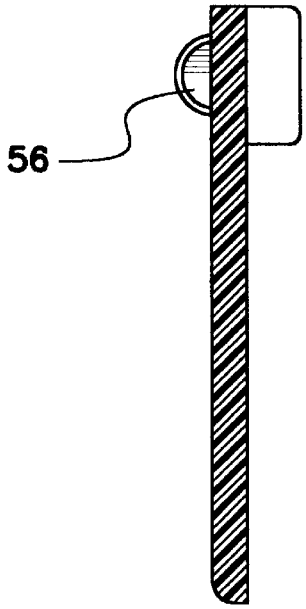
FIG. 4 is a schematic cross-sectional view taken along line 4—4 of the present invention.
Figure 5:
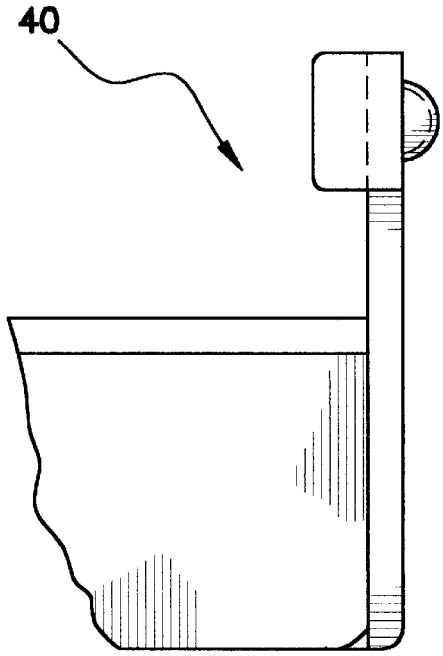
FIG. 5 is a schematic exploded view of the present invention.
Figure 6:
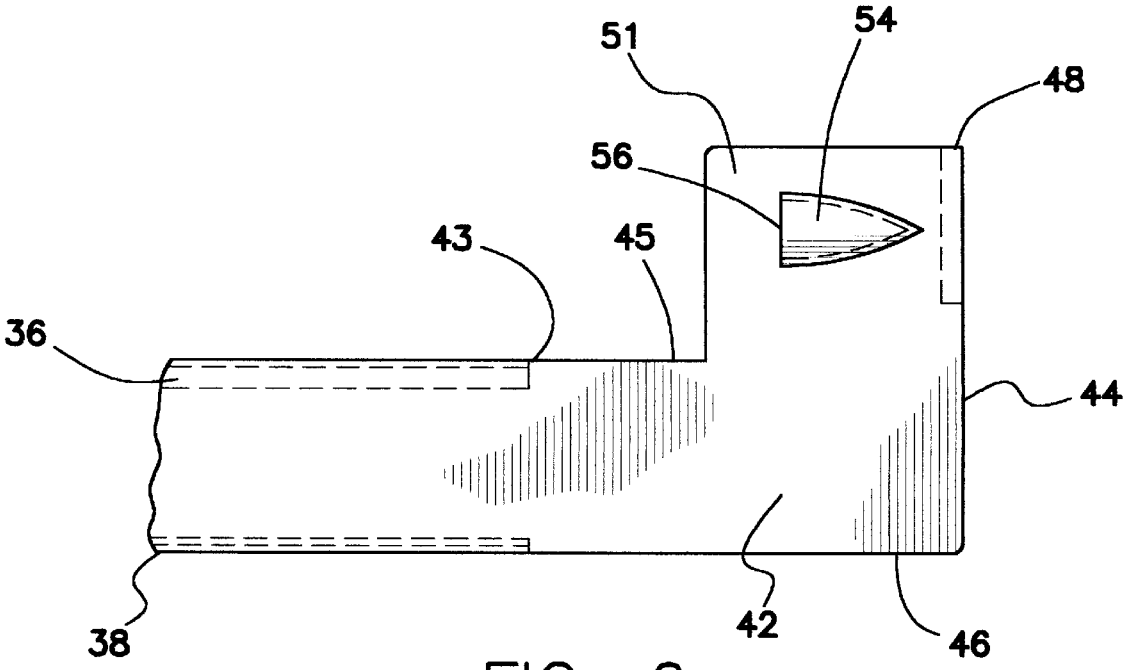
FIG. 6 is a schematic side view of the securing means of the present invention.

With reference now to the drawings, and in particular to FIGS. 1 through 6 thereof, a new stove cover device embodying the principles and concepts of the present invention and generally designated by the reference numeral 10 will be described.

As best illustrated in FIGS. 1 through 6, the stove cover device 10 generally comprises a stove 12 and covering member 20. The stove 12 has a top surface, shown through the covering member 20. The top surface has a back edge, a front edge and two side edges which are abutted against the covering member 20. A panel 14 extends along and fixedly coupled to the back edge. The panel 14 is orientated generally perpendicular to the top surface of the stove. The panel 14 has a plurality of actuating means thereon for actuating the stove.

The covering member 20 covers the top surface of the stove 12. The covering member 20 includes a plate 22. The plate has a top surface 24, a bottom surface 26, and a peripheral edge 28. The plate 22 has a generally rectangular shape.

A peripheral wall 30 extends away from and is integrally coupled to the peripheral edge 28. The peripheral wall 30 extends downwardly away from the plate 22. The peripheral wall 30 defines a first wall 31, a second wall 32, a third wall 33 and a fourth wall 34. The first 31 and second 32 walls are opposing walls, and the third 33 and fourth 34 walls are opposing walls. A juncture of the peripheral wall 30 and the plate 22 is curved and forms a ridge 36. The peripheral wall has a free edge 38. The free edge 38 is curved toward the bottom surface 26 of the plate 22. The peripheral wall 30 is orientated generally perpendicular to the plate 22. The peripheral wall 30 has a height between one and five inches and ideally has a height substantially equal to two inches.

A pair of securing means 40 removably secures the peripheral wall 30 to the panel 14 on the stove 12. Each of the securing means 40 comprises an arm 42. Each of the arms 42 is elongate and has a first end 43, a second end 44, a top edge 45 and a bottom edge 46. Each of the arms 42 is generally planar. Each of the first ends 43 of the arms 42 is fixedly coupled to the peripheral wall 30. A first of the arms 42 is positioned at a junction of the first 31 and third 33 walls and a second of the arms 42 is positioned at a junction of the second 32 and third 33 walls. The first arm generally lying a plane of the first wall 31, and the second arm generally lying a plane of the second wall 32. Each of the arms 42 has a bracket thereon 48. Each of the brackets 48 is generally L-shaped and has a first leg 51 and a second leg 52. Each of the legs is generally planar, and each of the first legs 51 has an edge integrally coupled to a top edge 45 of one of the arms 42 such that each of the second legs 52 is directed toward the other. The second legs 52 of the brackets are generally positioned adjacent to one of the second ends 44 of the arms 42.

A pair of gripping means 54 helps the user grip the securing means 40. Each of the gripping means 54 is a protrusion coupled to one of the first legs 51 of the brackets 48. The protrusions extend in opposite directions with relation to each other. Each of the protrusions is generally hollow and has an open end 56.

The covering member 20 comprises a resiliently flexible material. The resiliently flexible material ideally comprises a plastic.

In use, the covering member 20 is placed over the surface of the stove 12 when the stove is not in use. This allows the stove to be used additionally countertop space. The covering member 20 has two securing means 40 for holding the covering member to the panel on the stove. The gripping means 54 allow the user to pull the brackets 48 away from the panel 14 for ease of removal of the covering member 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed =readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stove cover device for covering a stove, the stove having a top surface having a back edge, a panel extending upwardly from said back edge, said device comprising:

a covering member for covering said top surface of said stove, said covering member comprising:

a plate, said plate having a top surface, a bottom surface, and a peripheral edge;

a peripheral wall, said peripheral wall extending away from and being integrally coupled to said peripheral edge, said peripheral wall defining a first wail, a second wall, a third wall and a fourth wall, said first and second walls being opposing walls, said third and fourth walls being opposing walls, a juncture of said peripheral wall and said plate being curved and forming a ridge;

a pair of securing means for removably securing said peripheral wall to said panel on said stove, each of said securing means being adapted for removably coupling to the panel of the stove, each of said securing means comprising an arm, each of said arms being elongate and having a first end, a second end, a top edge and a bottom edge, each of said arms being generally planar, each of said first ends of said arms being fixedly coupled to said peripheral wall, a first of said arms being positioned at a junction of said first and third walls and a second of said arms being positioned at a junction of said second and third walls, said first arm generally lying a plane of said first wall, said second arm generally lying a plane of said second wall, each of said arms having a bracket thereon adapted for releasably securing about said panel of said stove.

2. The stove cover device as in claim 1, wherein;

each of said brackets is generally L-shaped and has a first leg and a second leg, each of said legs being generally planar, each of said first legs having an edge integrally coupled to a top edge of one of said arms such that said second legs are directed toward each other, each of said second legs of said brackets being generally positioned adjacent to one of the second ends of said arms.

3. The stove cover device as in claim 1, further comprising;

a pair of gripping means for gripping said securing means, each of said gripping means being a protrusion coupled to one of said brackets, each of said protrusions generally extending in opposite directions with relation to each other.

4. A stove cover system, said system comprising:

a stove, said stove having a top surface, said top surface having a back edge, a front edge and two side edges, a panel extending along and fixedly coupled to said back edge, said panel being orientated generally perpendicular to said top surface of said stove, said panel having a plurality of actuating means thereon for actuating said stove;

a covering member for covering said top surface of said stove, said covering member comprising:

plate, said plate having a top surface, a bottom surface, and a peripheral edge, said plate having a generally rectangular shape;

a peripheral wall, said peripheral wall extending away from and being integrally coupled to said peripheral edge, said peripheral wall extending downwardly away from said plate, said peripheral wall defining a first wall, a second wall, a third wall and a fourth wall, said first and second walls being opposing walls, said third and fourth walls being opposing walls, a juncture of said peripheral wall and said plate being curved and forming a ridge, said peripheral wall having a free edge, said free edge being curved toward said bottom surface of said plate, said peripheral wall being orientated generally perpendicular to said plate, said peripheral wall having a height substantially equal to two inches;

a pair of securing means for removably securing said peripheral wall to said panel on said stove, each of said securing means comprising an arm, each of said arms being elongate and having a first end, a second end, a top edge and a bottom edge, each of said arms being generally planar each of said first, ends of said arms being fixedly coupled to said peripheral wall, a first of said arms being positioned at a junction of said first and third walls and a second of said arms being positioned at a junction of said second and third walls, said first arm generally lying a plane of said first wall, said second arm generally lying a plane of said second wall, each of said arms having a bracket thereon, each of said brackets being generally L-shaped and having a first leg and a second leg, each of said legs being generally planar, each of said first legs having an edge integrally coupled to a top edge of one of said arms such that said second legs are directed toward each other, each of said second legs of said brackets being generally positioned adjacent to one of the second ends of said arms;

a pair of gripping means for gripping said securing means, each of said gripping means being a protrusion, each of said protrusions being coupled to one of said first legs of said brackets, each of said protrusions generally extending in opposite directions with relation to cash other, each of said protrusions being generally hollow and having an open end; and said covering member comprising a resiliently flexible material, said resiliently flexible material comprising a plastic.

5. A stove cover device for covering a stove, the stove having a top surface with a back edge arid a panel extending upwardly from said back edge, said device comprising:

a covering member for covering said rop surface of said stove, said covering member comprising:

a plate having a top surface, a bottom surface, and a peripheral edge;

a peripheral wall extending away from and being integrally coupled to said peripheral edge;

securing means for removably securing said peripheral wall to opposite ends of said panel on said stove;

wherein said peripheral wall defines a first wall, a second wall, a third wall and a fourth wall, said first and second walls being opposing walls, said third and fourth walls being opposing walls, each of said securing means comprising an arm, each of said arms being elongate and having a first end and a second end, each of said first ends of said arms being fixedly coupled to said peripheral wall, a first of said arms being positioned at a junction of said first and third walls and a second of said arms being positioned at a junction of said second and third walls, each of said first and second arms extending upwardly from said top surface of said plate, each of said arms having a bracket thereon adapted for releasably securing about said panel of said stove.

* * * * *